US006290040B1

(12) United States Patent
Chen

(10) Patent No.: US 6,290,040 B1
(45) Date of Patent: Sep. 18, 2001

(54) SOFT HANDLE LUGGAGE

(76) Inventor: Wei-Chih Chen, No. 59, Hen Chung St., Wu Chile, Ta Chia Cheng, Taichung Hsien (TW)

( * ) Notice: Subject to any disclaimer, the term of this patent is extended or adjusted under 35 U.S.C. 154(b) by 0 days.

(21) Appl. No.: 09/562,088

(22) Filed: May 1, 2000

(51) Int. Cl.[7] ..... A45C 13/26
(52) U.S. Cl. ..... 190/39; 190/115; 16/104
(58) Field of Search ..... 190/18 A, 39, 190/115; 16/104

(56) References Cited

U.S. PATENT DOCUMENTS 4,364,150 * 12/1982 Remington ..... 190/115
5,440,783 * 8/1995 Allardyce et al. ..... 16/103

* cited by examiner

*Primary Examiner*—Sue A. Weaver
(74) *Attorney, Agent, or Firm*—Harrison & Egbert

(57) ABSTRACT

A soft handle for luggage including a soft grip tube, a fabric strap, an arcuate bracing rod, and two fastening bases. The fabric strap is put through the soft grip tube such that the unexposed portion of the fabric strap is braced by the arcuate bracing rod, and that two exposed ends of the fabric strap are fastened to the luggage frame by the two fastening bases in conjunction with a plurality of rivets.

2 Claims, 6 Drawing Sheets

SOFT HANDLE LUGGAGE

TECHNICAL FIELD

The present invention relates generally to luggage, and more particularly to a soft handle of luggage.

BACKGROUND ART

As shown in FIGS. 1 and 2, a prior art luggage is provided with a soft handle 10 which is formed of a fabric body 11 and a leather jacket 12 fitted over the fabric body 11. The fabric body 11 is fastened at both ends thereof to a luggage frame 13 by a plurality of rivets 14.

Such a prior art soft handle 10 as described above is defective in design because the soft handle 10 is apt to deform due to the weight of the articles contained in the luggage. The deformed handle is likely to cause discomfort or even injury to the hand. In addition, the fabric body 11 is fastened to the luggage frame 13 by a plurality of rivets 14, which undermine the aesthetic effect of the luggage and are apt to rust. Moreover, a trademark label cannot be easily attached to the prior art soft handle 10.

SUMMARY OF THE INVENTION

The primary objective of the present invention is to provide a luggage with a soft handle which is free from the shortcomings of the prior art soft handle described above.

In keeping with the principle of the present invention, the foregoing objective of the present invention is attained by a soft handle which is fastened to a luggage frame and is formed of a soft grip tube, a fabric strap, an arcuate bracing rod, and two fastening bases. The fabric strap is put through the soft grip tube and is supported by the arcuate bracing rod such that both ends of the fabric strap are fastened to the top side of the luggage frame by the two fastening bases.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
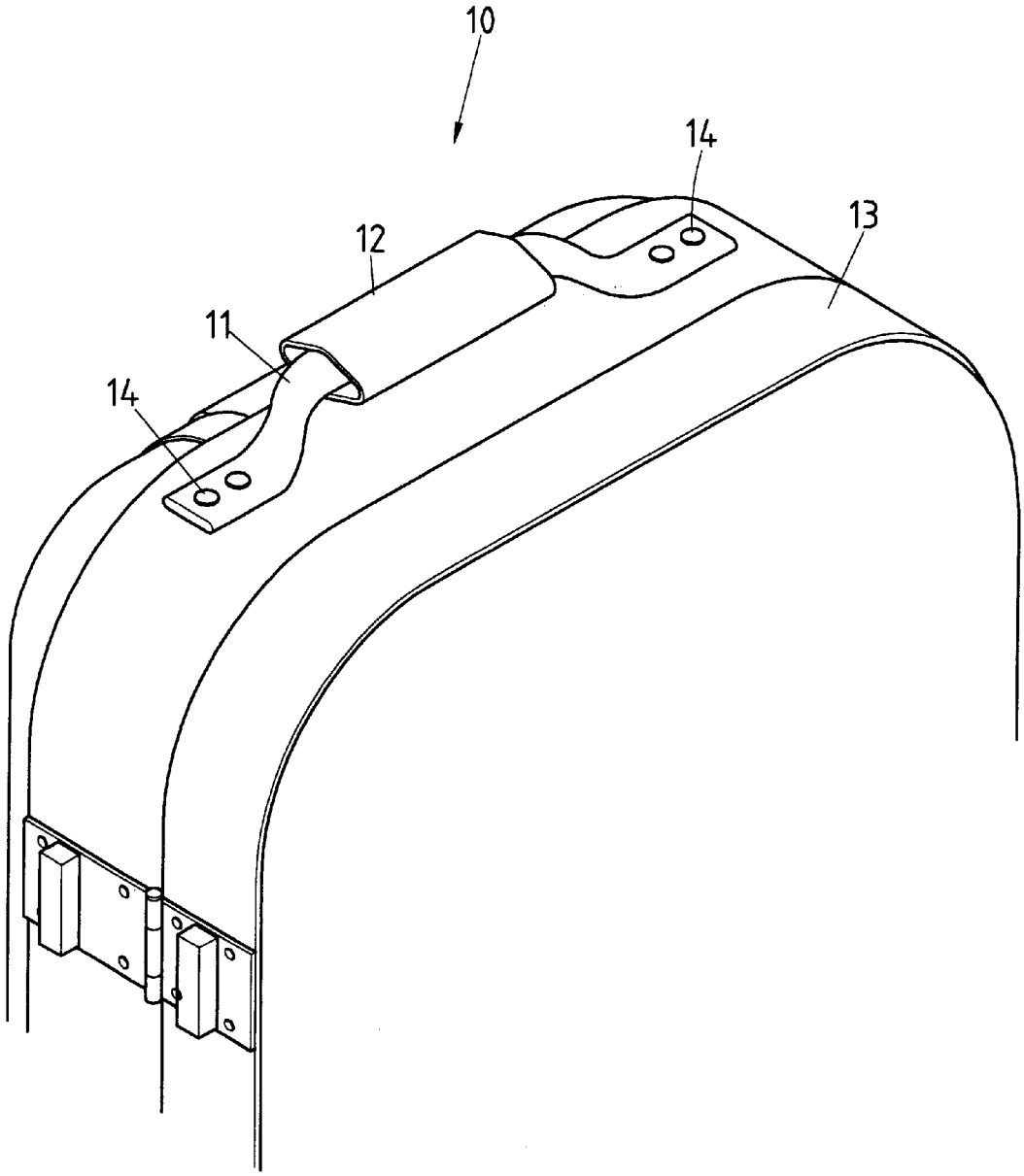
FIG.1 PRIOR ART
FIG. 1 shows a perspective view of a prior art soft handle of luggage.
Figure 2:
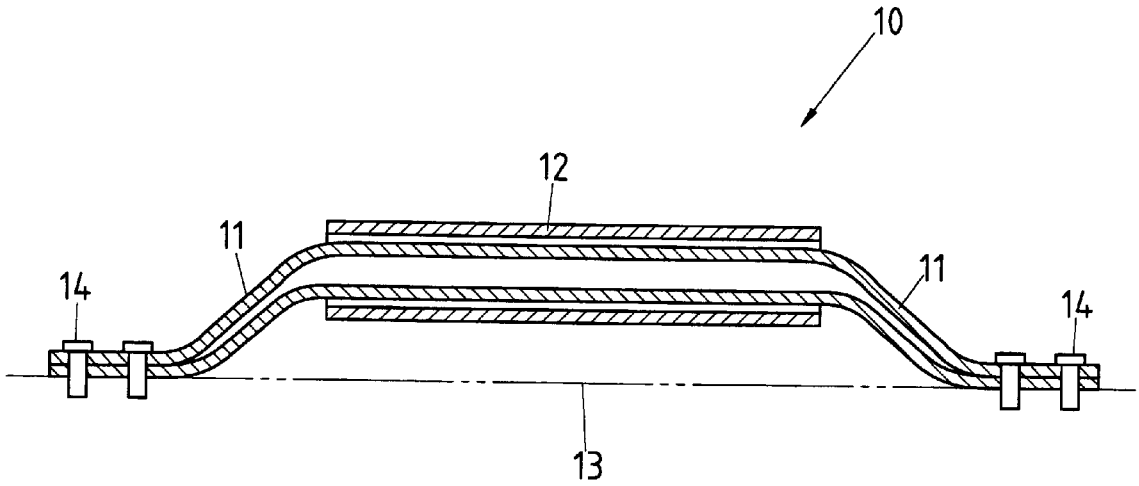
FIG.2 PRIOR ART
FIG. 2 shows a sectional view of the prior art soft handle of luggage.
Figure 3:
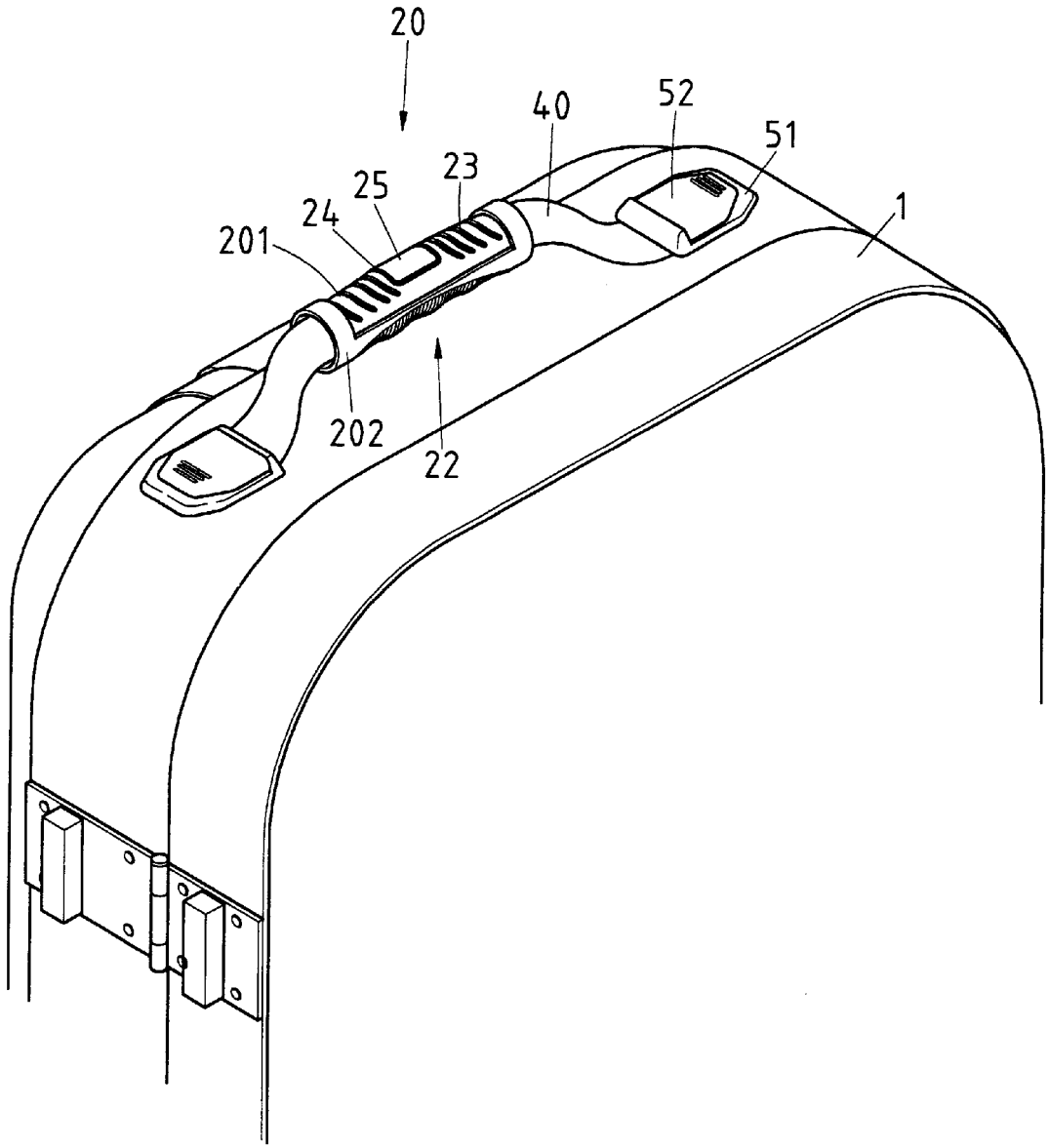
FIG. 3 shows a perspective view of a soft handle of the present invention in conjunction with luggage.
Figure 4:
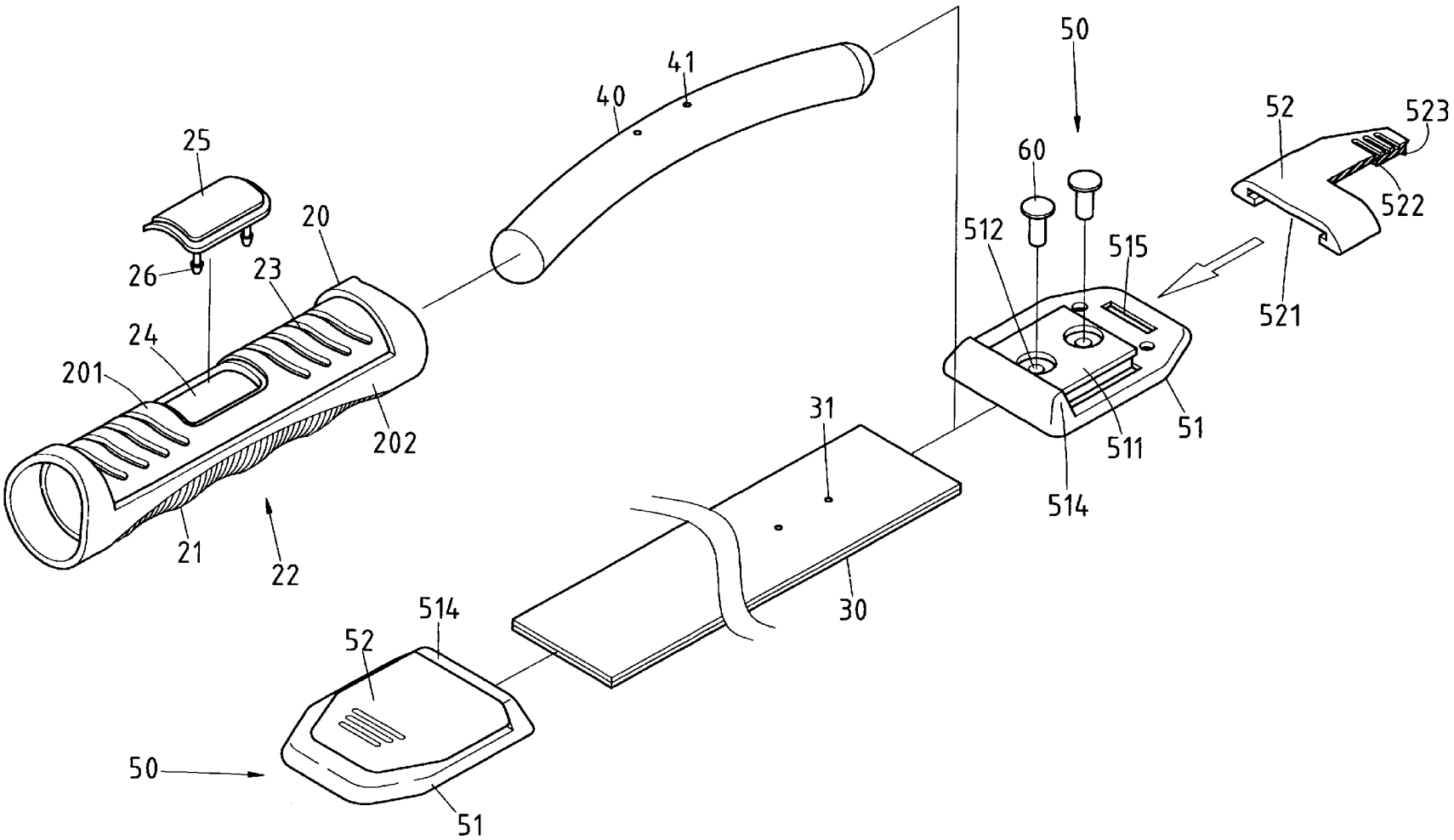
FIG. 4 shows an exploded view of the soft handle of the present invention.

As shown in FIGS. 3–7, a soft handle embodied in the present invention is fastened to a luggage 1 and is formed of soft grip tube 20, a fabric strap 30, an arcuate bracing rod 40, and two fastening bases 50.

The soft grip tube 20 is made of a soft plastic material and is provided in the underside thereof with an elastic piece 21 having a corrugated surface 22. The soft grip tube 20 is provided in the upper surface thereof with a plurality of arcuate through holes 23, and, in the center of the upper surface thereof, with a rectangular hole 24 dimensioned to receive a locating piece 25. The locating piece 25 is provided in the underside thereof with two retaining pillars 26 which are inserted into the soft grip tube 20.

The fabric strap 30 is put through the soft grip tube 20 such that both ends of the fabric strap 30 are exposed, and such that the unexposed portion of the fabric strap 30 is braced by the bracing rod 40.The fabric strap 30 is provided in the top thereof with two holes 31 into which the two retaining pillars 26 of the locating piece 25 are inserted. The arcuate bracing rod 40 is provided in the top of the fabric strap 30 with two retaining holes 41 in which the two retaining pillars 26 are retained via the two holes 31 of the fabric strap 30.

Figure 5:
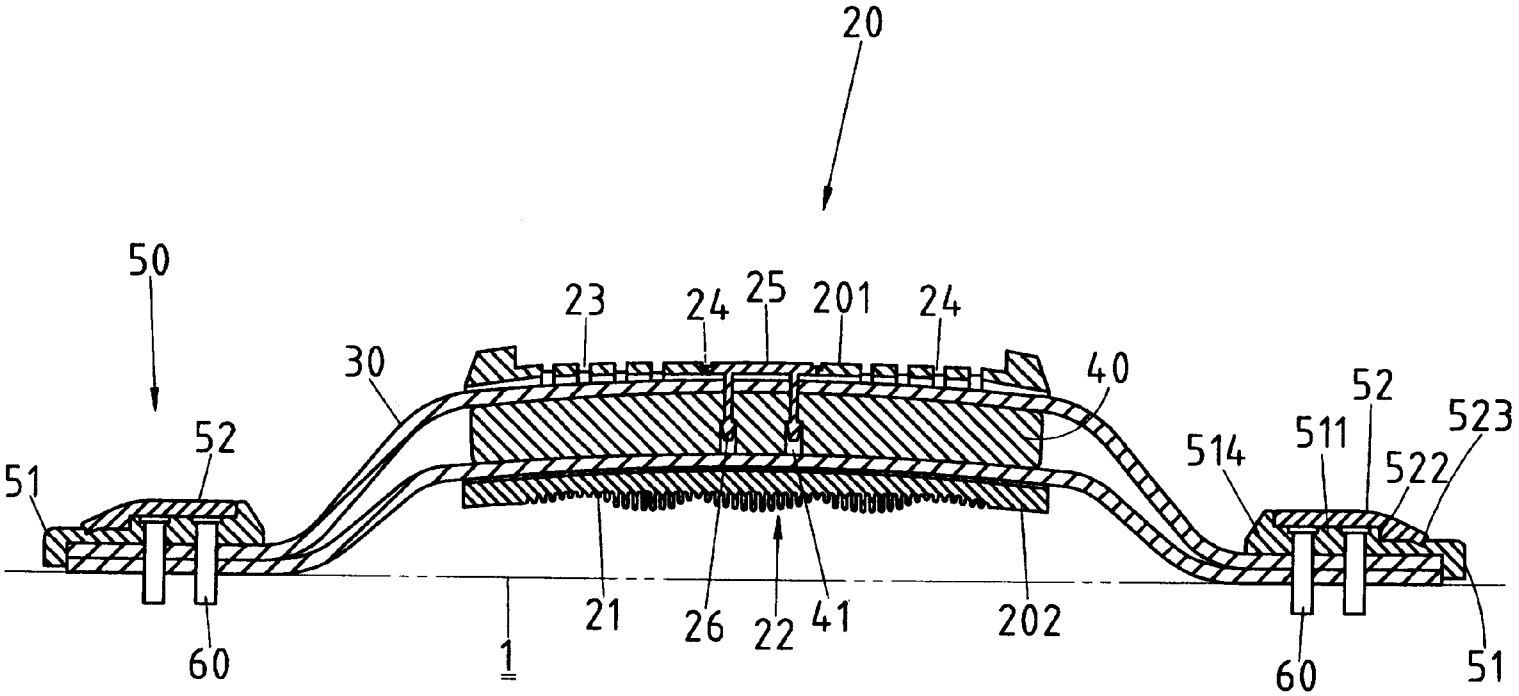
FIG. 5 shows a sectional view of the soft handle of the present invention.
Figure 6:
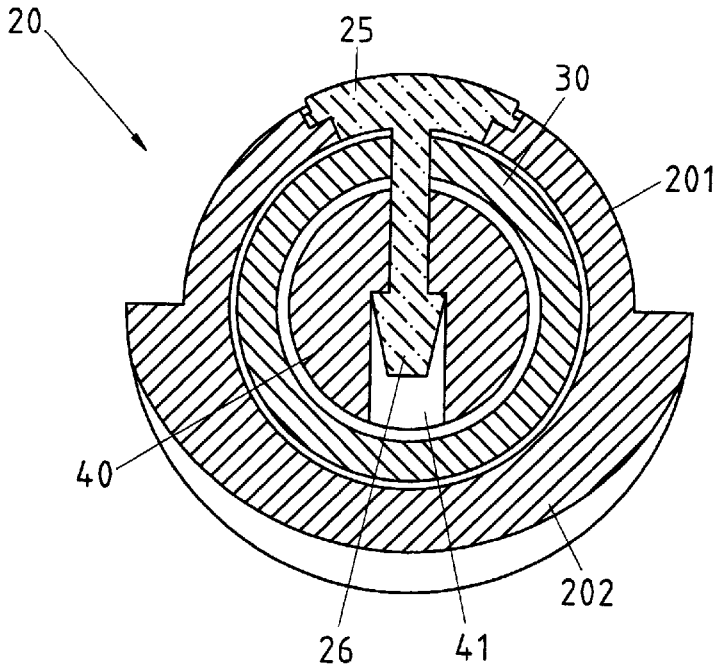
FIG. 6 shows a cross-sectional view of the soft handle of the present invention.
Figure 7:
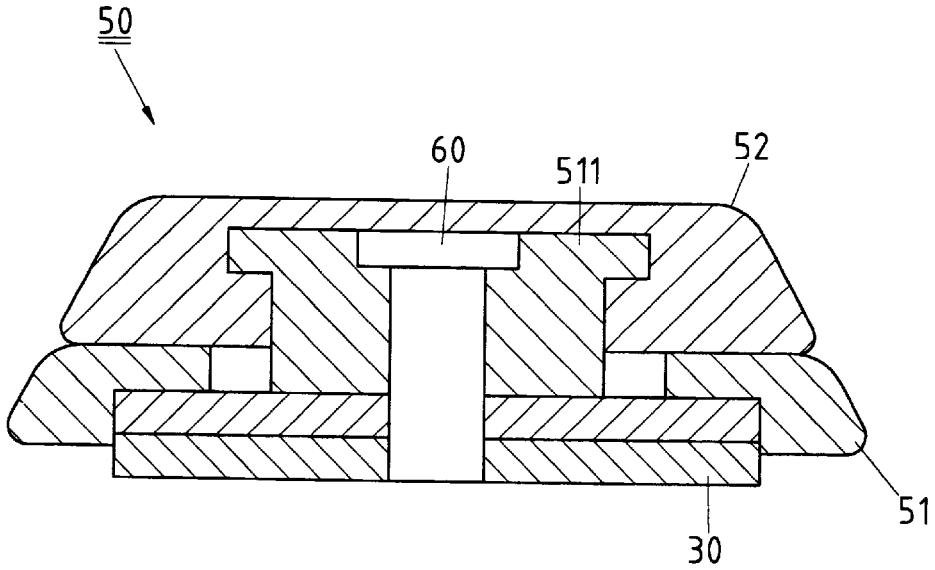
FIG. 7 shows a cross-sectional view of the fastening base of the present invention.

As shown in FIG. 5, the two exposed ends of the fabric strap 30 are affixed to the frame of the luggage 1 by the fastening bases 50, which are formed of a seat 51 and a cover 52. The seat 51 is provided with a retaining seat 511 having two riveting holes 512 and a stopping wall 514, and is further provided with a retaining slot 515 opposite in location to the stopping wall 514. The cover 52 is provided in the underside of a front end thereof with a retaining block 523 and an arresting wall 522, and is further provided in the underside of a rear end thereof with a receiving slot 521.

Each of the two exposed ends of the fabric strap 30 is fastened to the frame of the luggage 1 by two rivets 60 which are fastened onto the exposed end of the fabric strap 30 and the frame of the luggage 1 via the riveting holes 512. The two rivets 60 are concealed by the cover 52 which is connected to the seat 51 such that the retaining block 523 of the cover 52 is retained in the retaining slot 515 of the seat 51, and such that the retaining seat 511 is received in the receiving slot 521 of the cover 52.

The soft grip tube 20 is formed of an upper tube portion 201 and a lower tube portion 202 by injection molding.

The soft grip tube 20 is provided with the corrugated surface 22 and the arcuate through holes 23, which give added comfort to a hand holding the soft grip tube 20. In addition, the soft grip tube 20 is immune from a severe deformation caused by the weight of the articles contained in the luggage 1.

The soft grip tube 20 is provided with the rectangular hole 24 for receiving the locating piece 25. The locating piece 25 can be used to separate the rectangular flat surface for attaching a trademark pattern thereto.

The rivets 60 used to fasten the fabric strap 30 are concealed by the covers 52 of the two fastening bases 50. As a result, the rivets 60 are less likely to rust. In addition, the aesthetic effect of the soft handle of the present invention is not compromised by the rivets 60 which are well concealed by the covers 52 of the fastening bases 50.

I claim:

1. A soft handle of luggage, said soft handle comprising:

a soft grip tube provided in an underside thereof with an elastic piece having a corrugated surface, and in an upper surface thereof with a plurality of arcuate through holes and a rectangular hole located in the center of said soft grip tube and dimensioned to receive therein a locating piece whereby said locating piece is provided in an underside thereof with two retaining pillars extending into said soft grip tube;

a fabric strap put through said soft grip tube such that both ends of said fabric strap are exposed, and that an unexposed portion of said fabric strap is contained by said soft grip tube;

a bracing rod disposed in said unexposed portion of said fabric strap to brace said unexposed portion whereby said arcuate bracing rod is provided in the top with two retaining holes in which said two retaining pillars are retained via two holes of the top of said fabric strap; and two fastening bases, with each being formed of a seat and a cover, each of said seats being provided with a retaining seat having a plurality of riveting holes and a stopping wall, each of said seats further provided with a retaining slot opposite in location to said stopping wall, said respective covers being provided in an underside thereof with a retaining block, an arresting wall, and a receiving slot;

each of said two exposed ends of said fabric strap being fastened to a luggage frame by a plurality of rivets whereby said rivets are fastened onto said exposed ends of said fabric strap and the luggage frame via said riveting holes, said cover being connected to said seat such that said retaining block of said cover is retained in said retaining slot of said seat, and that said retaining seat is received in said receiving slot of said cover.

2. The soft handle of a luggage as defined in claim 1, wherein said soft grip tube is formed of an upper tube portion and a lower tube portion by injection molding.

* * * * *